US009277321B2

(12) United States Patent
Toivanen et al.

(10) Patent No.: US 9,277,321 B2
(45) Date of Patent: Mar. 1, 2016

(54) DEVICE DISCOVERY AND CONSTELLATION SELECTION

(71) Applicant: Nokia Corporation, Espoo (FI)

(72) Inventors: Timo J. Toivanen, Mantsala (FI); Jarmo I. Saari, Turku (FI); Kari J. Leppanen, Helsinki (FI)

(73) Assignee: Nokia Technologies Oy, Espoo (FI)

( * ) Notice: Subject to any disclaimer, the term of this patent is extended or adjusted under 35 U.S.C. 154(b) by 355 days.

(21) Appl. No.: 13/716,660

(22) Filed: Dec. 17, 2012

(65) Prior Publication Data

US 2014/0169569 A1 Jun. 19, 2014

(51) Int. Cl.
*H04R 5/00* (2006.01)
*H04R 5/04* (2006.01)
*H04S 7/00* (2006.01)

(52) U.S. Cl.
CPC .... *H04R 5/04* (2013.01); *H04S 7/30* (2013.01)

(58) Field of Classification Search
CPC ..... H04S 3/00; H04S 7/301; H04S 7/00; H04S 7/30; H04S 7/302; H04R 5/04; H04R 29/00; H04R 5/02; H04R 3/12; H04R 3/005; H04R 5/027; H04R 5/00; G08B 23/00; H04B 5/0006; H04B 5/0062; H04B 7/0842; H04H 20/48; H04M 1/7253; H04M 1/72558; G09G 3/3233; G11B 20/00; G11B 27/034; G11B 27/10; G11B 27/00; G01S 5/0289; H04L 41/12; H04L 12/5895; H04L 51/38; H04W 40/20; H04W 64/00; H04N 5/77; H04N 5/772; H04N 1/00127; H04N 9/8063; H04N 9/8205; H04N 5/92; G10H 2210/305; G06F 3/048; G06Q 10/10; G10L 19/008
USPC ..... 381/1, 17, 93, 18, 310, 111, 121, 92, 381/77, 66, 71.11, 11, 2, 303, 58, 59, 56, 381/300, 61; 700/94; 708/322; 379/406.01, 379/406.08, 406.03, 32.01, 388.02, 392.01, 379/406.05; 704/201, E21.002; 455/567, 455/575.1, 596.1, 450, 41.2
See application file for complete search history.

(56) References Cited

U.S. PATENT DOCUMENTS 7,630,501 B2 * 12/2009 Blank et al. ..... 381/58
8,199,941 B2 6/2012 Hudson et al. ..... 381/303

(Continued)

FOREIGN PATENT DOCUMENTS

EP 1 894 439 B1 3/2008
WO WO 2006/131894 A2 12/2006
WO WO 2011/144795 A1 12/2011

OTHER PUBLICATIONS

Koskela, et al.,"Evolution Towards Smart Home Environments; Empirical Evaluation of Three User Interfaces":, Journal Personal and Obiquitous Computing, vol. 8, Issue 3-4, (Jul. 2004), (1 page).

(Continued)

*Primary Examiner* — Vivian Chin
*Assistant Examiner* — Ubachukwu Odunukwe
(74) *Attorney, Agent, or Firm* — Harrington & Smith

(57) ABSTRACT

There is described discovery of a plurality of audio devices, and for the discovered audio devices are determined relative positions thereof and distances therebetween. The determined relative positions and distances are used to select a constellation of audio devices from the discovered plurality. This constellation is selected for playing or recording of a multi-channel audio file so as to present an audio effect such as a spatial audio effect. Channels for the multi-channel audio file are allocated to different audio devices of the selected constellation, which are controlled to synchronously play back or record their respectively allocated channel or channels of the multi-channel audio file. In a specific embodiment the determined distances are used to automatically select the constellation and include distance between each pair of audio devices of the plurality. Several embodiments are presented for determining the distances and relative positions.

18 Claims, 5 Drawing Sheets

(56) References Cited

U.S. PATENT DOCUMENTS

| | | | | |
|---|---|---|---|---|
| 8,279,709 | B2 | 10/2012 | Choisel et al. | 367/127 |
| 8,316,154 | B2 * | 11/2012 | Yoneda | 709/248 |
| 2002/0122003 | A1 * | 9/2002 | Patwari et al. | 342/450 |
| 2003/0119523 | A1 * | 6/2003 | Bulthuis | 455/456 |
| 2004/0071294 | A1 | 4/2004 | Halgas, Jr. et al. | 381/59 |
| 2004/0209654 | A1 * | 10/2004 | Cheung et al. | 455/567 |
| 2005/0190928 | A1 | 9/2005 | Noto | 381/77 |
| 2007/0116306 | A1 | 5/2007 | Riedel et al. | 381/303 |
| 2008/0177822 | A1 * | 7/2008 | Yoneda | 709/202 |
| 2008/0207123 | A1 | 8/2008 | Andersen | 455/41.1 |
| 2009/0310790 | A1 | 12/2009 | Sinton et al. | 381/2 |
| 2010/0105325 | A1 * | 4/2010 | Halla et al. | 455/41.2 |
| 2010/0119072 | A1 | 5/2010 | Ojanpera | 381/17 |
| 2010/0135118 | A1 | 6/2010 | Van Leest et al. | 367/124 |
| 2010/0260348 | A1 * | 10/2010 | Bhow et al. | 381/81 |
| 2012/0128160 | A1 | 5/2012 | Kim et al. | 381/17 |
| 2013/0044894 | A1 | 2/2013 | Samsudin et al. | 381/92 |
| 2013/0226324 | A1 * | 8/2013 | Hannuksela et al. | 700/94 |
| 2014/0050454 | A1 * | 2/2014 | Slotte | 386/201 |
| 2014/0362995 | A1 * | 12/2014 | Backman et al. | 381/17 |

OTHER PUBLICATIONS

"In Stereo", http://instereo.com.au/, (2011), (2 pages).

Raykar, et al., "Position Calibration of Microphones and Loudspeakers in Distributed Computing Platforms", IEEE Transactions on Speech and Audio Processing, (Aug. 27, 2003), (29 pages).

Summit Semiconductor, LLC, "SpeakerFinder Technology" Automated Home Theater Speaker Configuration and Setup, (Feb. 9, 2011), (14 pages).

http://store.sony.com/webapp/wcs/stores/servlet/StoreCatalogDisplay?langId=-1&storeId=10151&catal . . . , (2012), (4 pages).

* cited by examiner

Figure 1: Prior Art

DEVICE DISCOVERY AND CONSTELLATION SELECTION

CROSS REFERENCE TO RELATED APPLICATION

This application concerns subject matter related to that disclosed in co-owned U.S. patent application Ser. No. 13/588,373 (filed on Aug. 17, 2012).

TECHNICAL FIELD

The exemplary and non-limiting embodiments of this invention relate generally to discovery of a constellation of independent radio devices and their physical positions relative to one another, for example discovering such devices for the purpose of a multi-channel audio playback where different devices in the constellation play back different audio channels such as stereo or surround sound channels.

BACKGROUND

The related US patent application mentioned above generally concerns capture of different audio channels by different and independent devices, for example capture of left, right and center channels by microphones on multiple different mobile handsets to record audio. These different channels may then be combined into a surround sound audio file. For a subjectively good and spacious-sounding audio recording, it is generally preferred that at least some of the microphones be spaced apart by up to several meters, and for surround sound the spacing should further be in more than one direction. Audio richness due to microphone spacing is especially improved if the microphones are omni-directional rather than directional. That co-owned patent application similarly discloses using cameras on two different mobile handsets to record left and right video channels for stereo video recordings; widely spaced cameras enable a better video depth and different handsets can provide a wider video base for capturing 3D video.

Now consider that there is a multi-channel audio file which a listener seeks to play back. Like spacing of the recording microphones, richness when playing back the multi-channel audio file is enhanced by having the loudspeakers also properly placed, but the audio file is of course not tied to any particular set of loudspeakers. Unlike for example fixed-location speakers in a home or commercial theater system which are set up with spatial relations in mind, the physical location of portable wireless speakers can be arbitrary. This can prevent the listener from experiencing an aimed spatial audio experience. Regardless of the listener's familiarity with specifics of audio technology, an aimed spatial experience is what people have come to expect from a 5:1 or even 7:1 arrangement for multi-channel audio related for example to watching movies. Hardwired speakers are typically spatially situated purposefully to achieve a proper surround sound. A similar spatial pre-arrangement of wireless loudspeakers with assigned audio channels tends to lose effectiveness over time when individual wireless loudspeakers are relocated away from the position designated for the surround-sound channel provided to it. The teachings herein address that deficiency.

Additionally, whether the loudspeakers are wired or wireless those previous audio systems that rely on pre-arranged spatial positioning of the speakers had the centralized host device that is handling the audio file (e.g., a conventional stereo amplifier or a host/master mobile phone) output different ones of the audio channels to different speakers or different speaker-hosting devices. These teachings also overcome that prior art feature, which is limiting if the speakers cannot be assumed to always remain in the same spatial position relative to one another.

SUMMARY

According to a first exemplary aspect the invention there is a method comprising: discovering a plurality of audio devices, including determining relative positions thereof and distances therebetween; using the determined relative positions and distances to select a constellation of audio devices from the discovered plurality for playing or recording of a multi-channel audio file so as to present an audio effect; allocating channels for the multi-channel audio file to different audio devices of the selected constellation; and controlling the audio devices of the selected constellation to synchronously play back or record their respectively allocated channels of the multi-channel audio file.

According to a second exemplary aspect the invention there is an apparatus comprising at least one processor, and a memory storing a program of computer instructions. In this embodiment the processor is configured with the memory and the program to cause the apparatus to: discover a plurality of audio devices, including determining relative positions thereof and distances therebetween for each pair of the plurality; use the determined relative positions and distances to select a constellation of audio devices from the discovered plurality for playing or recording of a multi-channel audio file so as to present an audio effect; allocate channels for the multi-channel audio file to different audio devices of the selected constellation; and control the audio devices of the selected constellation to synchronously play back or record their respectively allocated channels of the multi-channel audio file.

According to a third exemplary aspect the invention there is a computer readable memory tangibly storing a program of computer readable instructions which are executable by at least one processor. In this aspect the program of computer readable instructions comprises: code for discovering a plurality of audio devices, including determining relative positions thereof and distances therebetween for each pair of the plurality; code for using the determined relative positions and distances to select a constellation of audio devices from the discovered plurality for playing or recording of a multi-channel audio file so as to present an audio effect; code for allocating channels for the multi-channel audio file to different audio devices of the selected constellation; and code for controlling the audio devices of the selected constellation to synchronously play back or record their respectively allocated channels of the multi-channel audio file.

These and other aspects are detailed further below.

DETAILED DESCRIPTION

Figure 1:
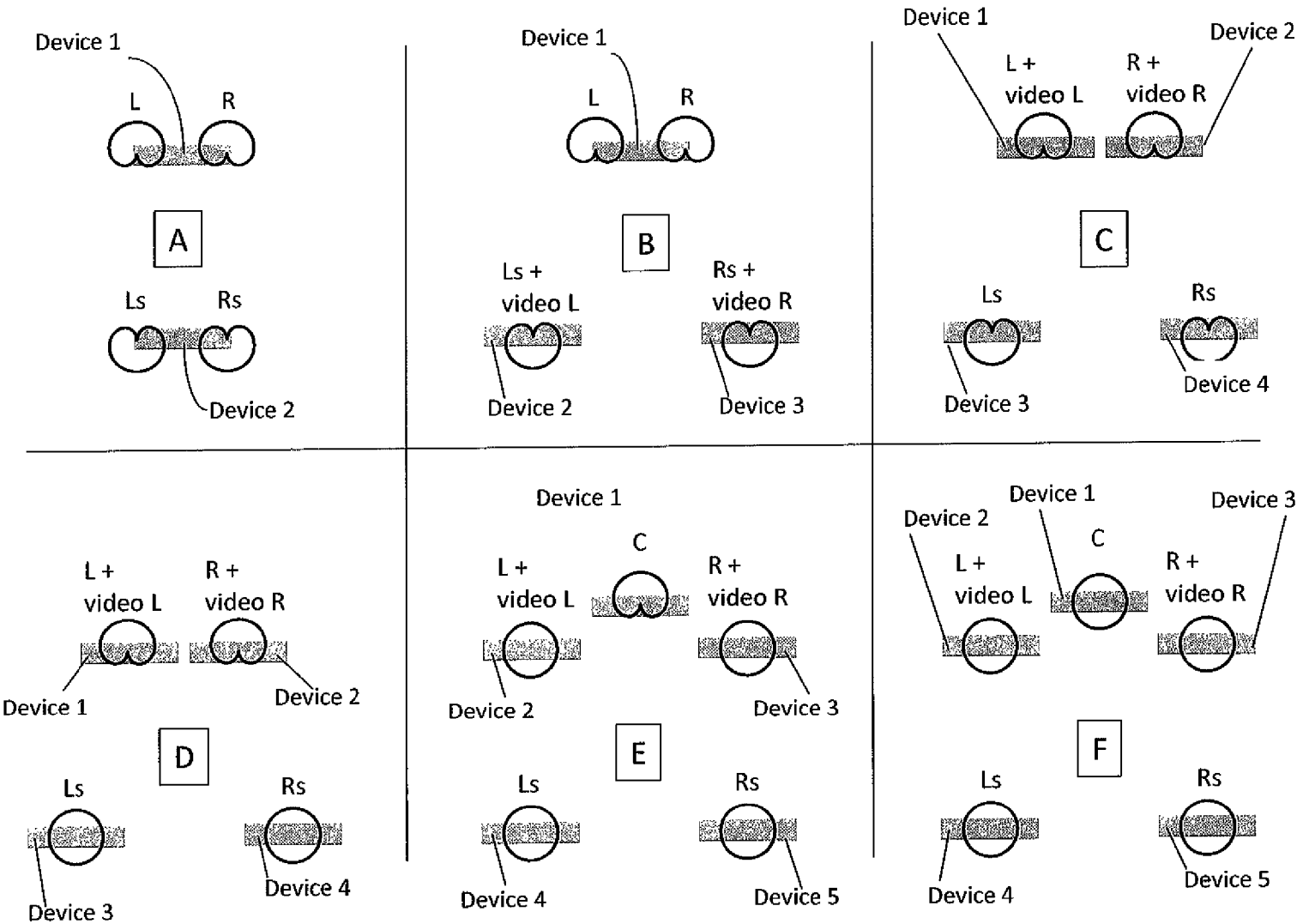
FIGS. 1A-F reproduces FIGS. 5A-F of co-owned U.S. patent application Ser. No. 13/588,373 and each illustrate a different setup of devices for playing back or recording a multi-channel audio file and in some case also recording a multi-channel video file according to non-limiting examples of how these teachings might select a constellation of speaker devices.

The exemplary and non-limiting embodiments detailed below present a way for discovering the physical positions of different loudspeakers relative to one another, and then selecting a constellation of those loudspeakers that is appropriate for playing back a multi-channel audio file. The constellation has multiple distinct speakers, each outputting in the audible range different channels of the unitary multi-channel audio file. For a better context of the flexibility of these teachings the examples below consider a variety of different-type of audio devices; some may be mobile terminals such as smart phones, some may be only stand-alone wireless speakers which may or may not have the capability of 'knowing' the relative position of other audio devices in the constellation, and some may be MP3-only devices with some limited radio capability, to name a few non-limiting examples. So long as some other audio device has the capacity to discover neighboring audio devices, the discovering audio device can discover any other audio devices which themselves lack such discovering capability, learn the relative positions of all the various neighbor audio devices according to the teachings below, and then form an audio constellation appropriate for the sound file to be played back. In the below examples any of the above types of host devices for a loudspeaker are within the scope of the term 'audio device', which refers to the overall host device rather than any individual loudspeaker unit. In typical implementations each audio device will have wireless connectivity with the other audio devices, as well as the capability for sound reproduction/play back and possibly also sound capture/recording.

Any given audio device is not limited to hosting only one loudspeaker. In different implementations of these teachings any such audio device can host one loudspeaker which outputs only one of the audio multi-channels (see for example FIG. 1E), or it may host two (or possibly more) loudspeakers which can output the same audio multi-channel (such as for example a mobile handset having two speakers which when implementing these teachings are considered too close to one another to output different audio multi-channels), or one audio device may host two (or possibly more) loudspeakers which each output different audio multi-channels (such as for example two speakers of a single mobile handset outputting different left- and right-surround audio channels, see for example FIG. 1A). Other implementations may employ combinations of the above (see for example FIG. 1B). In more basic implementations where individual audio devices are not distinguished in the discovery phase as having one or multiple loudspeakers, each host audio device may be assumed to have only one loudspeaker and the same audio channel allocated to the device is played out over all the loudspeakers hosted in that individual audio device.

FIG. 1A-F each illustrate a different constellation of audio devices for playing back a multi-channel audio file and in some cases also a multi-channel (3D) video file according to non-limiting embodiments of these teachings. FIGS. 1A-F are reproduced from FIGS. 5A-F of the cross-referenced and co-owned U.S. patent application Ser. No. 13/588,373, and so may be considered prior art. While the specific examples of the teachings below are in the context of discovering multiple different audio devices and selection of an appropriate constellation of those audio devices for playback of a multi-channel audio file, they are equally adaptable for playback of multi-channel video files as well as for establishing an appropriate constellation of devices for capturing multi-channel audio and/or video (where microphones or cameras are assumed to be present in the respective audio devices of the examples below). Playback of a multi-channel video file assumes the video channels are provided to projectors or to a common display screen, which can be provided via wired interfaces or wireless connections. For audio-video multi-channel files the playback of audio and video are synchronized in the file itself, in which case synchronizing the audio playback among the various audio devices would result in synchronized video playback also.

FIGS. 1A-F show various different examples of how two or more audio devices could be used to output different channels of a multi-channel audio file (and/or video file) using the techniques detailed herein. Being taken from the above-referenced co-owned application which concerns microphones, there are illustrated some cardioid/polar patterns (FIG. 1A) and some omni-directional patterns (FIG. 1F), but these patterns are less relevant when these teachings are implemented for audio device discovery and selection for outputting different sound channels a multi-channel audio file (as opposed to recording those different channels).

In FIGS. 1A-F, the designations L, R, C, Ls and Rs represent left (front) and right (front) sound channels, center sound channel, and left surround and right surround sound channels, respectively. Similarly, the designations video L and video R represent left and right video channels, respectively. In each of FIGS. 1A-F, the listener of audio and the viewer of video is ideally located at the center top of each respective drawing to best experience the richness of the multi-channel environment.

FIG. 1A illustrates a simple setup in which there are only two participating devices; device 1 is used to play back/output the front channels L, R; and device 2 is used to play back/output the rear channels Ls, Rs. FIG. 1B illustrates three participating devices arranged such that device 1 plays back front L and R audio channels; device 2 plays back rear audio channel Ls and video-L channel; and device 3 plays back rear audio channel Rs and video-R channel. FIG. 1C illustrates four participating devices: device 1 plays back front L audio channel and left video-L channel; device 2 plays back front audio channel R and right video-R channel; device 3 plays back rear audio channel Ls; and device 4 plays back rear audio channel Rs.

FIG. 1D is similar to FIG. 1C: device 3 plays back rear audio channel Ls; and device 4 plays back rear audio channel Rs. FIG. 1E illustrates five participating devices: device 1 plays back center channel audio C; device 2 plays back front L audio channel and left video-L channel; device 3 plays back front audio channel R and right video-R channel; device 4 plays back rear audio channel Ls; and device 5 plays back rear audio channel Rs. FIG. 1F is similar to FIG. 1E.

The arrangements of FIGS. 1A-F are exemplary of the set of audio devices which is discovered and selected for multi-channel playback according to these teachings. These are not intended to be comprehensive but rather serve as various examples of the possibilities which result from the various audio devices finding out their physical relative constellation. Knowing this constellation allows the audio system and audio devices to know what is the role of particular speakers in the whole system (for example, so device 2 can know that it is the right front channel speaker in the FIG. 1D system of devices and the left front speaker in the FIG. 1E system of devices).

By allowing audio devices to find out their distance to other audio devices, a mesh of speakers can be formed. Each audio device is a "node" and the distance between two nodes is a "path". Eventually, the path between each node is known and hence the constellation of speakers can be found by calculation. The constellation might be static or in some cases as with mobile terminals it may be dynamic, and so to account for the latter case in some implementations the audio device discovery is periodically or continuously updated. There are several ways to find out the paths between the different nodes/audio devices.

In some embodiments such as where each audio device has the capability for direct radio communications with each other audio device (for example, they are each a mobile terminal handset), synchronous operation can be enabled by a single (master) mobile terminal allocating the audio channels to the different other audio devices/mobile terminals via radio-frequency signaling (for example, via Bluetooth/personal area network including Bluetooth Smart, wireless local area network WLAN/WiFi, ANT+, device-to-device D2D communications, or any other radio access technology which is available among the audio devices), and the different audio devices/mobile terminals then synchronously play out their respectively assigned audio channel for a much richer audio environment. Or in other embodiments each audio device has the identical multi-channel audio file and only plays out its respectively assigned or allocated audio channels synchronously with the other audio devices.

Synchronous play back or recording can be achieved when one device, termed herein as the 'master' device, provides a synchronization signal for that playback, or alternatively deciding what (third-party) signal will serve as the synchronization signal. For example, the master device may choose that a beacon broadcast by some nearby WiFi network will be the group-play synchronization signal. The master device will in this case send to the 'slave' audio devices some indication of what is to be the synchronization signal the various audio devices should all use for the group play back. Whether master or slave device is grounded in synchronization; it may be that the extent of control that the master device exercises over all of the other 'slave' audio devices is limited only to controlling timing of the audio file playback, which in the above examples is accomplished via selection of the synchronization signal. In other embodiments the master device may additionally discover the neighbor audio devices, decide the constellation, and allocate which audio device is assigned which channel or channels of the multi-channel audio file for the group play by the constellation as a whole.

Figure 2:
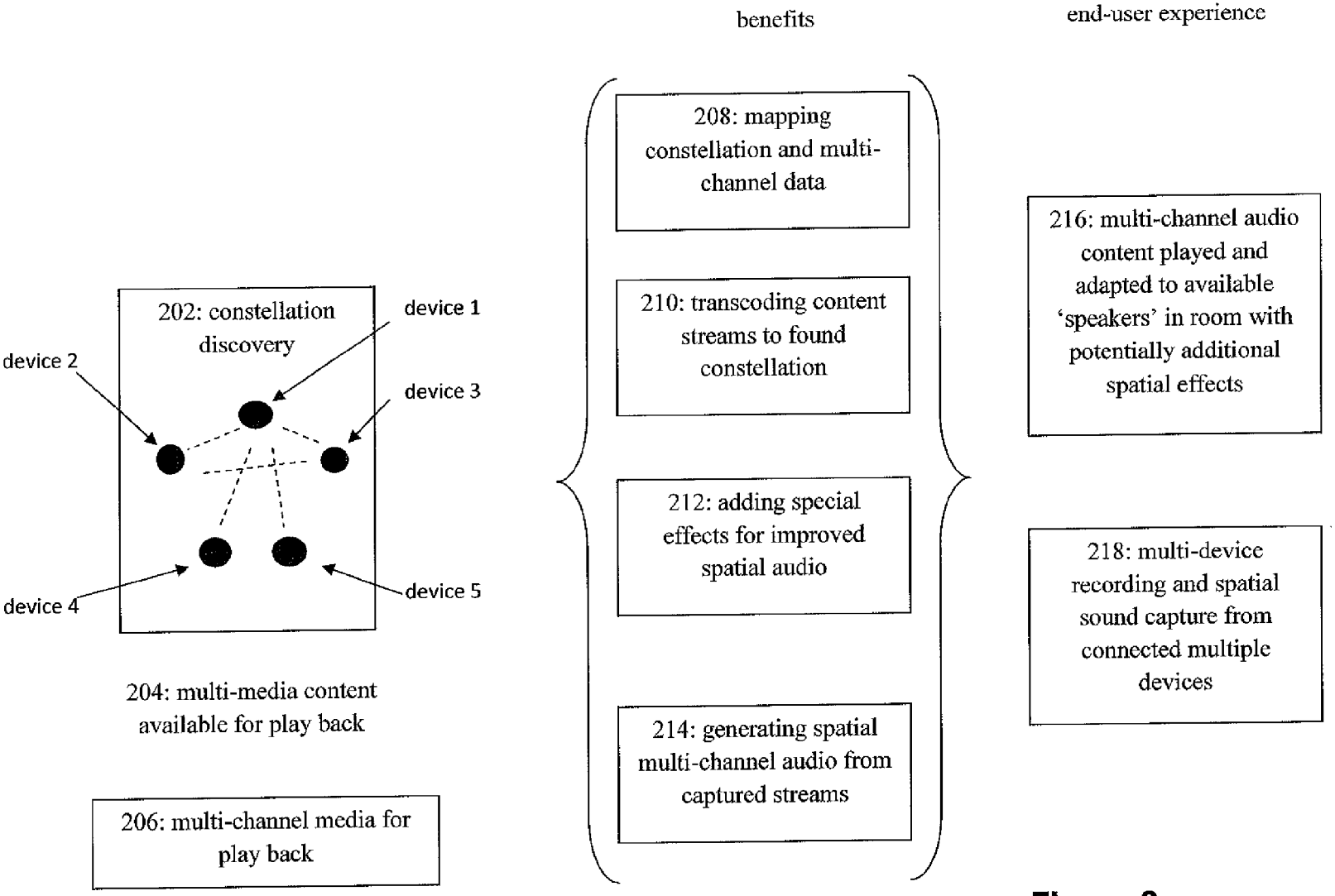
FIG. 2 is a schematic diagram showing an exemplary constellation selected after device discovery, and summarizing certain advantages and features consistent with the teachings herein.

Before detailing specific ways by which the audio devices may find one another, consider the overview of FIG. 2 which summarizes some implementation advantages of these teachings. Block 202 shows the result of the constellation discovery where each darkened circle is a node or audio device in its relative position and distance to other nodes. In this example the constellation of audio devices matches that of FIGS. 1E and 1F and so can support up to 5:1 audio surround sound. Note that the constellation recognizes the path (dotted line) between each audio device pair; so if for example device 1 is the master device and is running the algorithm to discover all its neighbor devices and select the constellation of them which is to be used for multi-channel play back, device 1 will still know the path between device 2 and device 3 even though it is not a node within that path pair. As will be seen from the detailed implementations for finding the path information, in some embodiments the master device 1 can learn this on its own or it can get at least some of the path information from one or more of the other audio devices 2-5.

At block 204 there is multi-media content made available for play back and at 206 the multi-channel media file is present on all the devices of the constellation for play back. As noted above, the entire multi-channel file may be present on each device (such as for example it is provided by one device for distribution among them all), or only individual channels of the overall multi-channel file may be made available to the audio devices to which the respective channel is assigned. In the case of streaming, from the master device or from some third-party source such as an Internet/WiFi podcast or some other multi-cast, the entire file or channel need not be present at once on every device of the constellation; it may be stored in a buffered memory in a rolling fashion and played out (synchronously) as later-received portions of the stream fill the input side of the respective buffer.

Advantages of some implementations are shown in the middle column of FIG. 2. Block 206 summarizes that there is a mapping of the constellation of devices to the multi-channel data file. Consider an example; when a multi-channel file is selected by a user at the master device for playback, the master device can look to see just how many channels there are and tailor its selection of the constellation from the world of its discovered neighbors to the number of distinct channels there are. For example if the master device finds six audio devices that might be usable for the playback, it may select one (or more) particular device-pair for the left and right speakers if the underlying file is stereo-only, but may choose an entirely different device-pair for the left-front and right-front channels when the underlying file is 5:1 surround sound. Thus the selection of the constellation depends on the multi-channel file to be played back, which is reflected in the mapping at block 208.

Transcoding the content streams to the found constellation at block 210 follows the mapping at block 208. At block 212 the play back devices can also add further spatial effects to improve richness of the user's audio environment. For blocks 208 and 210 the end user sees the beneficial results in that the multi-channel audio content is played out as adapted to the available speakers (audio devices) in the room or area, with potentially further spatial effects added from block 212.

Where these teachings are used to find a constellation of devices for multi-channel recording as in block 218, the end user experiences the benefit eventually in the playback but the selection of devices for recording follows generally the same principles for playback; proper spacing of microphones rather than proper spacing of audio devices. But for recording the microphones may additionally be configured, as a result of the constellation selection, as cardioid or omni-directional. Or if a given device's microphone is not configurable and can record only as an omni-directional microphone, that fact may bias that device's selection into or out of the constellation for recording.

Figure 3:
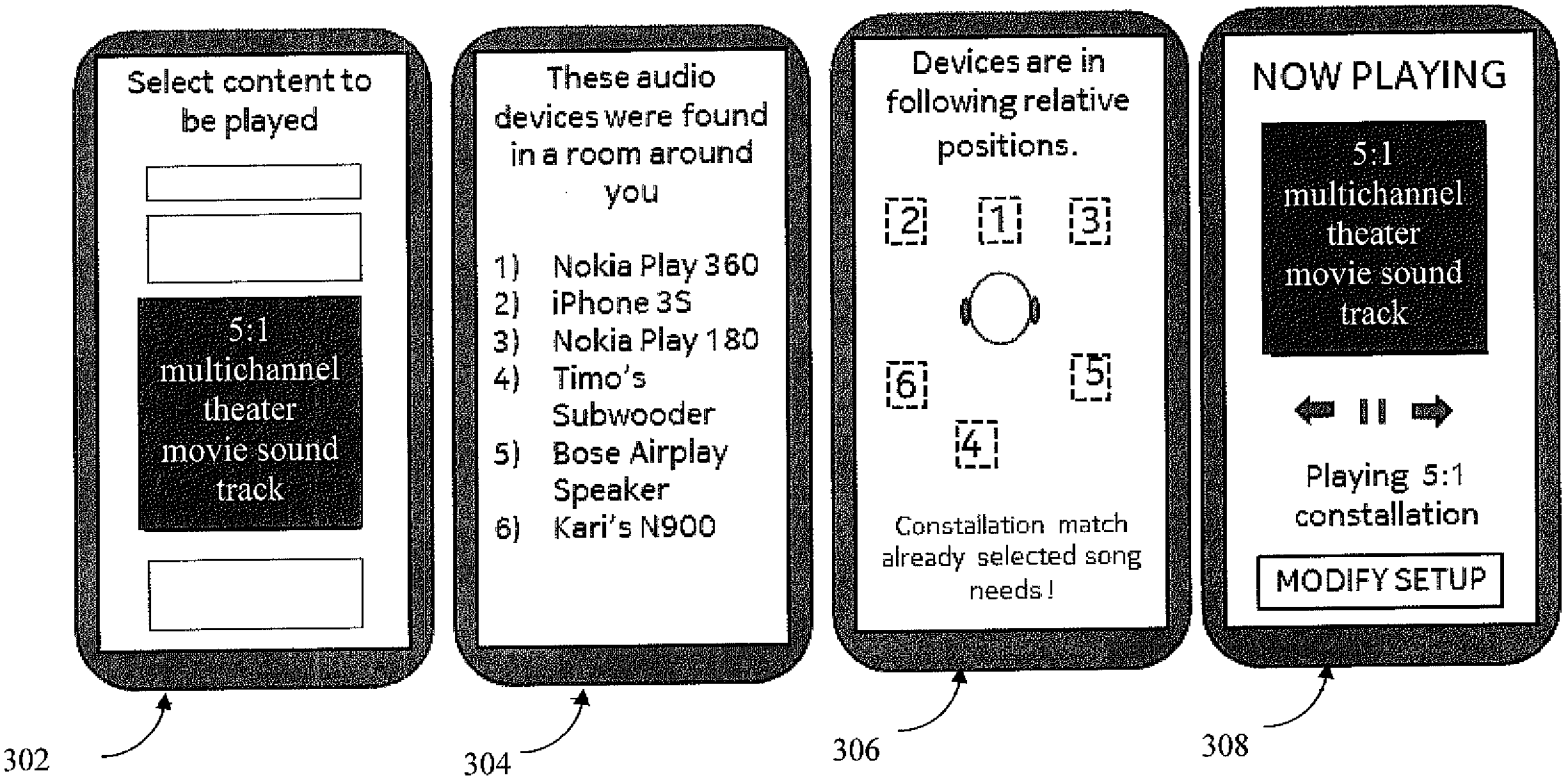
FIG. 3 illustrates a series of screen grabs from a master device which does the device discovery, constellation selection and control over group play back of a multi-channel file according to an exemplary embodiment of these teachings.

As a more specific example, consider that FIG. 3 shows different screen grabs of the user interface of the master device which runs a locally-stored software application to implement these teachings. The user selects a multi-channel file at 302 for play back, after which the master device discovers all of its neighbors, their relative locations of each device-pair, and the distances between each device-pair.

Where the master device has insufficient information for a given device it may discard such device from further consideration. Screen grab 304 shows the listing of all the discovered devices; in this example there are six of various different types: Nokia Play 360 and 180 are MP3/MP4 devices; iPhone 3S and Karl's N900 are smart phones; and Timo's subwoofer and Bose Airplay speaker are speaker-only devices. In some implementations there may be an option here for the user to exclude any of the listed devices from further consideration for the play back constellation. This may be useful for example if the user knows that the sound quality from the device listed at #2 is poor due to it having been dropped and damaged, or knows that the battery on the device listed at #3 is not sufficiently charged to be used for the whole duration of the play back.

Knowing that the selected multi-channel file is 5:1 surround sound, the implementing application finds a 'best-fit' for 5:1 play back from among those six discovered devices (or from among whichever plurality of devices remain available for inclusion in the constellation). Screen grab 306 shows the relative positions of all those discovered devices and that a constellation match has been made. In this case all six discovered devices are in the play back constellation. Note that screen grab 304 identifies device #4 as a sub-woofer; it is therefore non-directional and so its spatial location is not very relevant for the best fit constellation; it is the remaining five devices which will be allocated the directional channels L, Ls, C, R and Rs. Finally at 308 the master device indicates the various constellation members are playing the 5:1 multi-channel audio file. FIG. 3 is not intended to be limiting in how information is displayed to a user, but rather is presented to explain the underlying specific functions for how the constellation choices are made in this non-limiting embodiment.

As an opposing example assume that device 4 in FIG. 3 not only a sub-woofer and so its spatial position and distance from other devices is more relevant. In this case the implementing software could include device 4 in the constellation and possibly allocate to it the same Ls channel as device 6 to add richness to the sound play back. If instead the implementing software program chooses to exclude device 4 and not select it for the constellation, then device 4 would not be displayed at screen grab 306. In either case the best fit constellation based on spatial position and distances is devices 1-3 and 5-6, and device 4 can be added to enhance the low-frequency range (if it is a sub-woofer) or to enhance richness of an individual channel (the Ls channel in the opposing example above), or it can be excluded. None of these options depart from the constellation being selected to best fit 5:1 surround sound play back since in all cases the five directional (spatial) audio channels are always at devices 1-3 and 5-6 and device 4 is added if at all to enhance richness. Selecting device 4 instead of device 6 for the Ls channel would not be a best fit for 5:1 surround sound, given the spatial relations illustrated at screen grab 306.

Figure 4:
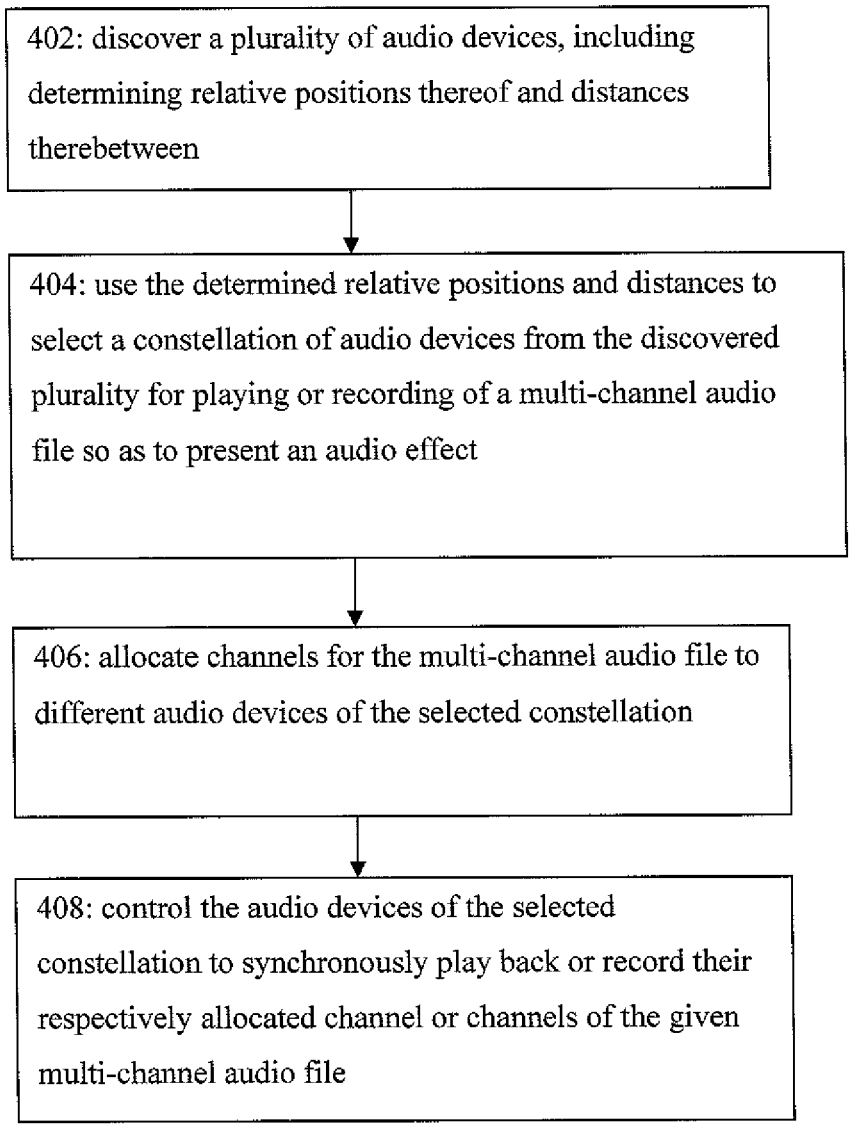
FIG. 4 is a process flow diagram illustrating a method, and actions performed at an implementing (e.g., master) device, and functions of different strings/groups of computer code, according to exemplary embodiments of these teachings.

FIG. 4 is a process flow diagram illustrating from the perspective of the master device or any other implementing device that decides the constellation and maps the distinct channels to the different constellation devices, certain but not all of the above detailed aspects of the invention. At block 402 the implementing device (which in some embodiments is the master audio device) discovers a plurality of audio devices, including it determines relative positions thereof and distances therebetween. This device discovery may be initiated manually by a user or it may be done automatically. Then at block 404 the implementing device uses the determined relative positions and distances to select a constellation of audio devices from the discovered plurality for playing or recording of a multi-channel audio file so as to present an audio effect. This selection of the constellation may also be automatic.

For the case of play back the implementing device knows the multi-channel audio file to be played back at the time it decides which devices will be in the constellation; 5:1 surround sound is the audio effect which is a spatial audio effect in the FIG. 3 example which the selection of the constellation is to present. In other embodiments the audio effect may be only stereo.

There is an idealized spatial arrangement for 5:1 surround sound, such as is shown for example at FIGS. 1E and 1F. To present this 5:1 surround sound spatial audio effect, in one particular embodiment the implementing device selects which audio devices best fit that idealized spatial arrangement and selects those as members of the constellation. The implementing device can of course select more devices than there are channels, for example if there were two devices found near the position of device 5 in FIG. 1E the implementing device can select them both and allocate the same right surround channel to them both. If for example the file to be played back is 5:1 surround sound but the implementing device finds only three devices, the spatial effect to be presented will be 3:1 surround sound because 5:1 is not possible given the discovered devices. For the more specific embodiment where the constellation is selected for a best fit to an idealized spatial arrangement for achieving the intended spatial audio effect, in this example the best fit may then be 3:1 surround sound so the best fit for the case of play back does not have to match the multi-channel profile of the file that is to be played back.

For the case of multi-channel recording, the implementing device selects a type or profile of the multi-channel file as the spatial audio effect it would like the recording to present, such as for example stereo or 5:1 surround sound. For example, the implementing device may choose the spatial audio effect it would like to achieve based on what is the spatial arrangement of the devices it discovers. The implementing device may find there are several possible constellations, and in the more particular 'best fit' embodiment choose the 'best fit' as the one which is deemed to record the richest audio environment. If there are only 4 devices found but their spatial arrangement is such that the best fit is 3:1 surround sound (L, C and R channels, such as where the fourth device is not located near enough to fit the 4-channel profile of FIG. 1C or 1D), the master device may then choose 3:1 and allocate channels accordingly.

At block 406 the implementing device allocates channels for the multi-channel audio file to different audio devices of the selected constellation. Note that in the case of recording the multi-channel audio file does not yet exist at the time of this allocating (thus the channels are for the file), but it is enough that the implementing/master device know the multi-channel profile (e.g., 5:1 surround sound with 3D video) to allocate channels to the devices in the constellation. Then at block 408 the implementing device controls the audio devices of the selected constellation to synchronously play back or record their respectively allocated channel or channels of the multi-channel audio file. As noted above, this control may be as light as transmitting a synchronization signal for the synchronous play back or recording, or for example sending an indication of where to find a synchronization signal to use for the synchronous play back or recording.

In one non-limiting embodiment the distances that are determined at block 402 are used to automatically select the constellation, and the determined distances comprise distance between each pair of audio devices, out of the plurality of audio devices. In another non-limiting embodiment the determined relative positions and distances are used at block 404 to automatically select a constellation of audio devices which best fits an idealized spatial arrangement for playing or recording of a multi-channel audio file.

In a still further non-limiting embodiment the plurality of audio devices are automatically discovered at block 402 as part of a periodic (or continuous) dynamic search for discoverable audio devices. Alternatively, they may be discovered via a static process, such as for example when a user walks into a room of friends having smart phones and the user manually starts an application for audio device discovery according to these teachings.

In one non-limiting embodiment noted above the multi-channel audio file of block 404 comprises a multi-channel audio-video file; and in that case the constellation of audio devices is selected at block 404 from the discovered plurality for group recording of the given multi-channel audio-video file; and the allocating at block 406 comprises allocating audio channels and video channels of the multi-channel audio-video file; and the audio devices of the selected constellation are controlled at block 408 to synchronously record their respectively allocated audio and video channel or channels.

Now are detailed various implementations of how the different audio devices can be discovered, and their relative locations and distances between one another known with sufficient granularity (the paths) to make a good constellation decision. Any one of the four implementations below can be used for discovering all the devices, or any given implementation can use a hybrid where one technique is used to discover some devices and another technique is used to discover others. Since each will resolve the paths between device-pairs, the end result of the hybrid approach can be usefully combined to make the constellation decision.

In a first embodiment the discovering at block 402 of the plurality of audio devices comprises, for at least the distances between at least some of the audio devices, using wireless polling messages to determine power loss between transmit and received power, and computing the distance therebetween from the determined power loss. For example, devices can use their radios to poll each other in order to learn the power loss between device pairs. Such polling may be considered in some implementations to be a kind of extension to Device Discovery, Advertisements and Service Discovery procedures that are conventional in some wireless systems such as Bluetooth, WLAN and others. Power loss can be calculated by knowing the transmitted power and then measuring the received power, such as for example through the well-known parameter Received Signal Strength Indicator (RSSI). Each polled device can send its measured RSSI which can be read by all the other neighbor devices, including even a master device that neither transmitted the poll nor received it. In this manner the master device can learn the path between device-pairs of which it is not a member. Power loss is the difference between the transmit and received power levels.

Distance computed from the determined power loss may be used to determine the relative positions between the audio devices. Specifically, by knowing the power loss relation to distance, and with proper assumptions as to radio-frequency (RF) propagation loss, then the absolute distance can be calculated. This all could happen automatically on lower protocols levels of a RF system, for example on the Device Discovery level or on a radio protocol signaling level. In one implementation a first device can transmit a beacon or other signal for measuring, a second device can measure it and reply the measurement (such as for example by relative signal strength indicator RSSI) to the first device. The first device then has all the information it needs to compute power loss; it need only subtract the measured received power from the second device from the transmit power the first device itself used to send the beacon or other signal. Or the first device can send to the second device an indication of what was its transmit power and the second device can compute power loss between the two devices. Once the power loss between all the audio device pairs are known, the distance estimates between all audio device pairs can then be used to calculate the approximate positions of all the audio devices.

Additionally, the power loss between transmit and received power can be determined from multiple measurements of received power over multiple radio-frequency channels that span the whole bandwidth of the radio access technology being used for the measurements. Accuracy of the power loss measurement, and therefore accuracy of the distance calculation, can be improved against multi-path fading by measuring the power loss over the whole frequency band of the related wireless RF system and by repeating this measurement multiple times per frequency channel. For example, in the Bluetooth system measurements over the multiple available Bluetooth channels covering whole 80 MHz frequency band would be performed. In the best case, all of the available frequency channels cover a bandwidth larger than the so-called coherence bandwidth of the room in which the various audio devices are located. The lowest path-loss is least affected by multi-path fading and so these should be used for position calculation.

In a second embodiment the discovering at block 402 of the plurality of audio devices, including at least some of the relative positions thereof and at least some of the distances therebetween, comprises using image recognition to identify at least some of the audio devices from a captured visual image. The relative position of the audio devices can be analyzed by taking a picture (digital image) of the area where all the audio devices are visible and analyzing it. In this case the image can be analyzed using image recognition, for example shape recognition (similar to face recognition commonly found in image post-processing software). Alternatively, each audio device could mark themselves to be identified more easily in the image, such as for example displaying a certain color that is recognizable by the image analysis software as potentially an audio device. The path calculations from which the constellation is chosen can be improved by knowing the camera's relative pointing direction/viewing angle. Further precision may be achieved by analyzing a 360 degree panorama image, or a fish eye image taken with a special lens for that purpose, so that further spatial information such as angle information could be readily calculated to improve the path calculations.

In a third embodiment the discovering at block 402 of the plurality of audio devices, including at least some of the relative positions thereof and at least some of the distances therebetween, comprises receiving at a microphone audio calibration sequences from at least one loudspeaker of at least some of the plurality of audio devices and computing distance and direction from differences in the received audio calibration sequences. In this case an audio calibration sequence is used. For example, each audio device plays a sound which other audio devices having microphones can listen. The sound can include some device identification information or a training pattern, and could be sent on some frequencies outside the bounds of human hearing so as not to disrupt the device users. A further calibration sound can be the actual played content (a continual or periodic calibration while the multi-channel play back is ongoing) or a simple ring tone or some other fixed or otherwise recognizable sound. By knowing which audio device is making the sound received at a given microphone, the receiving device can compute the relative time difference between devices from those time differences. Also, the absolute distance can be calculated so long as system latencies are understood, which is a reasonable assumption. Then time synchronization between audio devices can be achieved by a certain training sound pattern together with some synchronized wireless transmission. An accurate common time-base would allow audio processing between devices along the lines of conventional digital signal processing (DSP) between devices, such as for example beamforming in addition to the constellation calculation.

Which leads to a fourth embodiment in which the audio calibration sequences from the third embodiment above are received at multiple microphones, and at least some of the relative positions are determined by beamforming among the multiple microphones. In the audio beamforming approach, individual audio devices should have multiple microphones to allow beamforming for the microphone signal. Device beamforming would allow detection of the direction from which the calibration signal is coming, and the calibration signal can be selected by blocking out any other un-wanted signal. Beamforming could also be used to discover angle information directly to learn the relative position information when constructing and deciding the constellation.

From the various embodiments and implementations above it can be seen that these teachings offer certain technical effects and advantages. Specifically, the automatic device discovery and constellation selection allows end users to experience an aimed multi-channel audio experience without the need to pay attention to how speakers are physically located relative to each other. This might be perceived as some 'black-box' technology from the user's perspective since the loudspeakers appear to be always organized in the correct way without any user effort. It is anticipated that implementations of these teachings can also enhance collegial and social shared experiences because as a new loudspeaker, even in a mobile phone, is brought by a new person into a room it can be automatically added to the existing constellation of play back devices without any user action, providing a topic for conversation and technological wonder.

The selected device constellation together with an accurate common time base for the play back would also allow a kind of audio digital signal processing feature among the participating audio devices as opposed to the conventional single-device type of processing, for example when microphone signals are beamed in different directions between multiple mobile terminal type audio devices, or when creating a spatial audio effect between the audio devices, or making the music play back beam to follow a user for the case where the user's location is known and updated in real or near real time. Multi-device music beamforming can further be used to actively cancel directional noise in some cases.

Additionally, knowledge of the specific device constellation can also allow for the recording of a three dimensional sound image with multiple microphones on different devices of the constellation, such as those of mobile phones working synchronously over a wireless link that goes between the devices.

The above teachings may be implemented as a stored software application and hardware that allows the several distinct mobile devices to be configured to make a synchronized stereo/multichannel recording or play back together, in which each participating device contributes one or more channels of the recording or of the play back. In a similar fashion, a 3D video recording can be made using cameras of the various devices in the constellation, with a stereo base that is much larger than the maximum dimensions of any one of the individual devices (typically no more than about 15 cm). Any two participating devices that are spaced sufficiently far apart could be selected for the constellation of devices that will record the three dimensional video.

In one embodiment such as discussed by example above with respect to FIG. 4 there may be one such application running on the master device only, which controls the other slave devices to play out or record the respective channel that the master device assigns. Or in other embodiments some or all of the participating devices are each miming their own application which aids in device discovery and path analysis.

For the case of play back the slave devices can get the whole multi-channel file, or only their respective channel(s), from the master device. For the case of recording each can learn their channel assignments from the master device, and then after the individual channels are recorded they can send their respectively recorded channels to the master device for combining into a multi-channel file, or all the participating devices can upload their respective channel recordings to a web server which does the combining and makes the multi-channel file available for download.

The various participating devices do not need to be of the same type. If the constellation devices are not all of the same model it is inevitable that there will be frequency response and level differences between them, but these may be corrected automatically by the software application; for recording by the devices these corrections can be done during mixing of the final multi-channel recording, and for play back these can be done even dynamically using the microphone of mobile-terminal type devices to listen to the acoustic environment during play back and dynamically adjust amplitude or synthesis of their respective channel play back because any individual device knowing the constellation and distances can estimate how the sound environment should sound be at its own microphone.

In the case of 3D video recording, at least two of the participating devices must have cameras. These cameras need not be of the same type since it is possible to align video images as an automatic post-processing step after the recording has already been captured by the individual cameras. Such alignment is needed anyway because any two users holding the devices capturing video will not be able to always point them in precisely the same direction.

Figure 5:
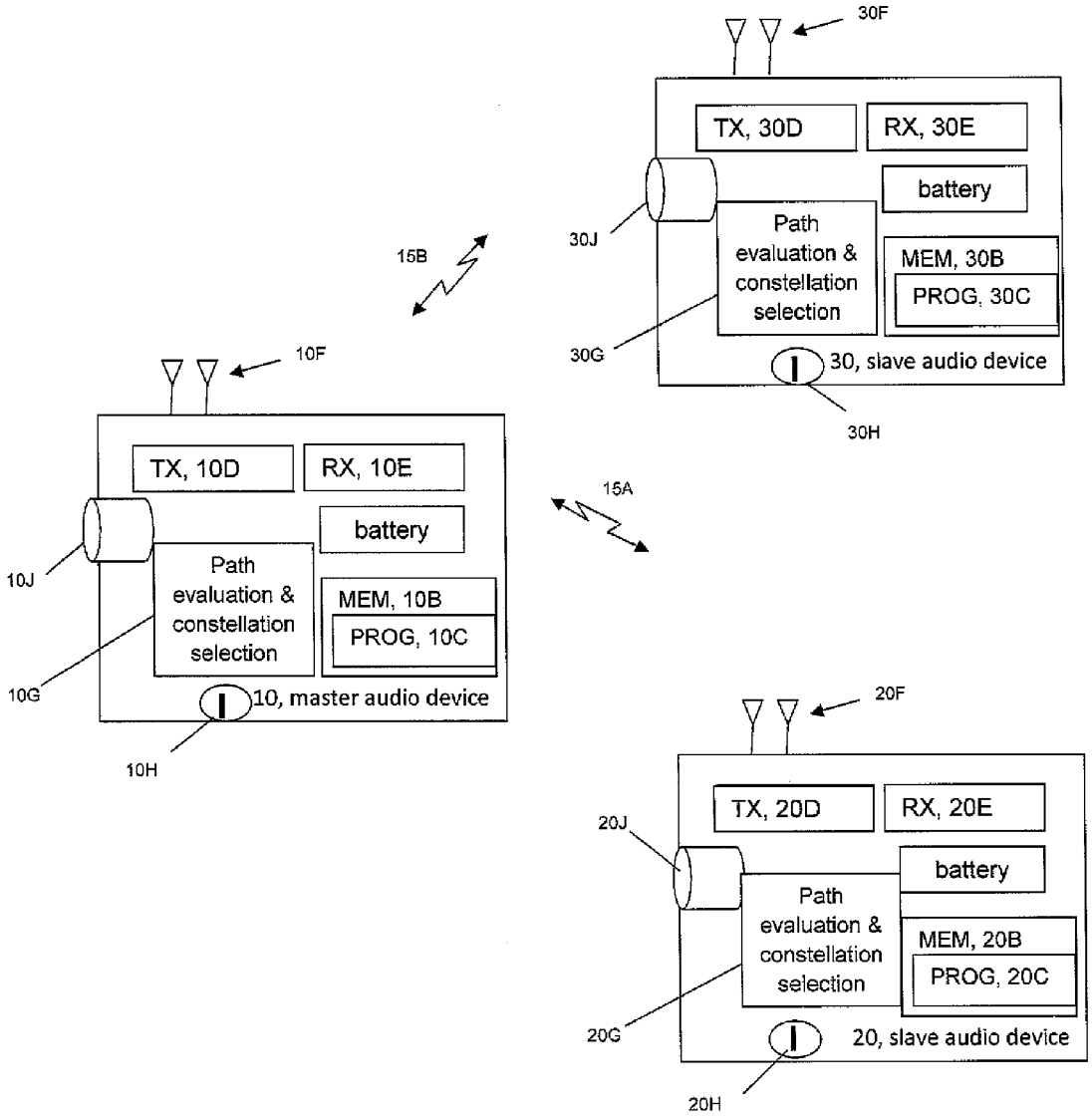
FIG. 5 is a schematic block diagram of three audio devices participating in a group play back or recording according to the teachings set forth herein, and illustrate exemplary apparatus which can be used for embodying and carrying out these teachings.

The master device and the other participating devices may for example be implemented as user mobile terminals or more generally referred to as user equipments UEs. FIG. 5 illustrates by schematic block diagrams a master device implemented as audio device 10, and two slave devices implemented as audio devices 20 and 30. The master audio device 10 and slave audio devices 20, 30 are wirelessly connected over a bidirectional wireless links 15A, 15B which may be implemented as Bluetooth, wireless local area network, device-to-device, or even ultrasonic or sonic links, to name a few exemplary but non-limiting radio access technologies. In each case these links are direct between the devices 10, 20, 30 for the device discovery and path information.

At least the master audio device 10 includes a controller, such as a computer or a data processor (DP) 10A, a computer-readable memory (MEM) 10B that tangibly stores a program of computer-readable and executable instructions (PROG) 10C such as the software application detailed in the various embodiments above, and in embodiments where the links 15A, 15B are radio links also a suitable radio frequency (RF) transmitter 10D and receiver 10E for bidirectional wireless communications over those RF wireless links 15A, 15B via one or more antennas 10F (two shown). The master audio device 10 may also have a Bluetooth, WLAN or other such limited-area network module whose antenna may be inbuilt into the module, which in FIG. 5 is represented also by the TX 10D and RX 10E. The master audio device 10 additionally may have one or more microphones 10H and in some embodiments also a camera 10J. All of these are powered by a portable power supply such as the illustrated galvanic battery.

The illustrated slave audio devices 20, 30 each also includes a controller/DP 20A/30A, a computer-readable memory (MEM) 20B/30B tangibly storing a program computer-readable and executable instructions (PROG) 20C/30C (a software application), and a suitable radio frequency (RE) transmitter 20D/30D and receiver 20E/30E for bidirectional wireless communications over the respective wireless links 15A/15B via one or more antennas 20F/30F. The slave audio devices 20, 30 may also have a Bluetooth, WLAN or other such limited-area network module and one or more microphones 20H/30H and possibly also a camera 20J/30J, all powered by a portable power source such as a battery.

At least one of the PROGs in at least the master device 10 but possibly also in one or more of the slave devices 20, 30 is assumed to include program instructions that, when executed by the associated DP, enable the device to operate in accordance with the exemplary embodiments of this invention, as detailed above. That is, the exemplary embodiments of this invention may be implemented at least in part by computer software executable by the DP of the master and/or slave devices 10, 20, 30; or by hardware, or by a combination of software and hardware (and firmware).

In general, the various embodiments of the audio devices 10, 20, 30 can include, but are not limited to: cellular telephones; personal digital assistants (PDAs) having wireless communication and at least audio recording and/or play back capabilities; portable computers (including laptops and tablets) having wireless communication and at least audio recording and/or play back capabilities; image capture and sound capture/play back devices such as digital video cameras having wireless communication capabilities and a speaker and/or microphone; music capture, storage and playback appliances having wireless communication capabilities; Internet appliances having at least audio recording and/or play back capability; audio adapters, headsets, and other portable units or terminals that incorporate combinations of such functions.

The computer readable MEM in the audio devices 10, 20, 30 may be of any type suitable to the local technical environment and may be implemented using any suitable data storage technology, such as semiconductor based memory devices, flash memory, magnetic memory devices and systems, optical memory devices and systems, fixed memory and removable memory. The DPs may be of any type suitable to the local technical environment, and may include one or more of general purpose computers, special purpose computers, microprocessors, digital signal processors (DSPs) and processors based on a multicore processor architecture, as non-limiting examples.

In general, the various exemplary embodiments may be implemented in hardware or special purpose circuits, software, logic or any combination thereof. For example, some aspects may be implemented in hardware, while other aspects may be implemented in embodied firmware or software which may be executed by a controller, microprocessor or other computing device, although the invention is not limited thereto. While various aspects of the exemplary embodiments of this invention may be illustrated and described as block diagrams, flow charts, or using some other pictorial representation, it is well understood that these blocks, apparatus, systems, techniques or methods described herein may be implemented in, as non-limiting examples, hardware, embodied software and/or firmware, special purpose circuits or logic, general purpose hardware or controller or other computing devices, or some combination thereof, where general purpose elements may be made special purpose by embodied executable software.

It should thus be appreciated that at least some aspects of the exemplary embodiments of the inventions may be practiced in various components such as integrated circuit chips and modules, and that the exemplary embodiments of this invention may be realized in an apparatus that is embodied as an integrated circuit. The integrated circuit, or circuits, may comprise circuitry (as well as possibly firmware) for embodying at least one or more of a data processor or data processors, a digital signal processor or processors, and circuitry described herein by example.

Furthermore, some of the features of the various non-limiting and exemplary embodiments of this invention may be used to advantage without the corresponding use of other features. As such, the foregoing description should be considered as merely illustrative of the principles, teachings and exemplary embodiments of this invention, and not in limitation thereof.

We claim:

1. A method comprising:

discovering a plurality of audio devices, including determining relative positions among respective audio devices of the plurality of audio devices and distances between the respective audio devices for each pair of the plurality;

using the determined relative positions and distances of the respective audio devices to select a constellation of audio devices from the discovered plurality for playing or recording of a multi-channel audio file so as to present an audio effect dependent on the determined relative positions and distances of the respective audio devices, wherein the determined distances are used to automatically select the constellation;

allocating channels for the multi-channel audio file to different audio devices of the selected constellation; and controlling the audio devices of the selected constellation to synchronously play back or record their respectively allocated channel or channels of the multi-channel audio file.

2. The method according to claim 1, wherein the determined relative positions and distances are used to automatically select the constellation of audio devices from the discovered plurality which best fits an idealized spatial arrangement for playing or recording of the multi-channel audio file.

3. The method according to claim 1, wherein the plurality of audio devices are automatically discovered as part of a periodic or continuous dynamic search for discoverable audio devices.

4. The method according to claim 1, wherein the multi-channel audio file comprises a multi-channel audio-video file; and further wherein:

the constellation of audio devices is selected from the discovered plurality for group recording of the multi-channel audio-video file;

the allocating comprises allocating audio channels and video channels of the multi-channel audio-video file to the different audio devices of the selected constellation; and the audio devices of the selected constellation are controlled to synchronously record their respectively allocated audio and video channel or channels.

5. The method according to claim 1, wherein controlling the audio devices comprises at least one of transmitting a synchronization signal for the synchronous play back or recording; and sending an indication of where to find a synchronization signal to use for the synchronous play back or recording.

6. The method according to claim 1, wherein discovering the plurality of audio devices comprises, for at least the distances between at least some of the audio devices, using wireless polling messages to determine power loss between transmit and received power, and computing the distance therebetween from the determined power loss.

7. The method according to claim 6, wherein the distance computed from the determined power loss is used to determine the relative positions between the said at least some of the audio devices.

8. The method according to claim 1, wherein discovering the plurality of audio devices, including at least some of the relative positions thereof and at least some of the distances therebetween, comprises using image recognition to identify at least some of the audio devices from a captured visual image.

9. The method according to claim 1, wherein discovering the plurality of audio devices, including at least some of the relative positions thereof and at least some of the distances therebetween, comprises receiving at a microphone audio calibration sequences from loudspeakers of at least some of the plurality of audio devices and computing distance and direction from differences in the received audio calibration sequences.

10. The method according to claim 9, wherein the audio calibration sequences are received at multiple microphones and the said at least some of the relative positions are determined by beamforming among the multiple microphones.

11. An apparatus comprising:

at least one processor; and a memory storing a program of computer instructions;

in which the processor is configured with the memory and the program to cause the apparatus to:

discover a plurality of audio devices, including determine relative positions among respective audio devices of the plurality of audio devices and distances between the respective audio devices for each pair of the plurality;

use the determined relative positions and distances of the respective audio devices to select a constellation of audio devices from the discovered plurality for playing or recording of a multi-channel audio file so as to present an audio effect dependent on the determined relative positions and distances of the respective audio devices, wherein the determined distances are used to automatically select the constellation;

allocate channels for the multi-channel audio file to different audio devices of the selected constellation; and control the audio devices of the selected constellation to synchronously play back or record their respectively allocated channel or channels of the multi-channel audio file.

12. The apparatus according to claim 11, wherein:

the multi-channel audio file comprises a multi-channel audio-video file;

the constellation of audio devices is selected from the discovered plurality for group recording of the multi-channel audio-video file;

allocating the channels comprises allocating audio channels and video channels of the multi-channel audio-video file to the different audio devices of the selected constellation; and the audio devices of the selected constellation are controlled to synchronously record their respectively allocated audio and video channel or channels.

13. The apparatus according to claim 11, wherein the processor is configured with the memory and the program to cause an apparatus to discover the plurality of audio devices by, for at least the distances between at least some of the audio devices, using wireless polling messages to determine power loss between transmit and received power, and computing the distance therebetween from the determined power loss.

14. The apparatus according to claim 13, wherein the distance computed from the determined power loss is used to determine the relative positions between the said at least some of the audio devices.

15. The apparatus according to claim 11, wherein the processor is configured with the memory and the program to cause an apparatus to discover the plurality of audio devices, including at least some of the relative positions thereof and at least some of the distances therebetween, by using image recognition to identify at least some of the audio devices from a captured visual image.

16. The apparatus according to claim 11, wherein the processor is configured with the memory and the program to cause an apparatus to discover the plurality of audio devices, including at least some of the relative positions thereof and at least some of the distances therebetween, by receiving at a microphone of the apparatus audio calibration sequences from at least one loudspeaker of at least some of the plurality of audio devices and computing distance and direction from differences in the received audio calibration sequences.

17. A non-transitory computer readable memory storing a program of computer readable instructions which are executable by at least one processor, the program of computer readable instructions comprising:

code for discovering a plurality of audio devices, including determining relative positions among respective audio devices of the plurality of audio devices and distances between the respective audio devices for each pair of the plurality;

code for using the determined relative positions and distances of the respective audio devices to select a constellation of audio devices from the discovered plurality for playing or recording of a multi-channel audio file so as to present an audio effect dependent on the determined relative positions and distances of the respective audio devices, wherein the determined distances are used to automatically select the constellation;

code for allocating channels for the multi-channel audio file to different audio devices of the selected constellation; and code for controlling the audio devices of the selected constellation to synchronously play back or record their respectively allocated channel or channels of the multi-channel audio file.

18. The memory according to claim 17, wherein the code for discovering the plurality of audio devices comprises, for at least the distances between at least some of the audio devices, code for using wireless polling messages to determine power loss between transmit and received power, and code for computing the distance therebetween from the determined power loss.

* * * * *

UNITED STATES PATENT AND TRADEMARK OFFICE

CERTIFICATE OF CORRECTION

PATENT NO. : 9,277,321 B2
APPLICATION NO. : 13/716660
DATED : March 1, 2016
INVENTOR(S) : Toivanen et al.

It is certified that error appears in the above-identified patent and that said Letters Patent is hereby corrected as shown below:

Claims

Claim 11, col. 15, line 40 --device-- should be inserted in between “memory” and “storing”.

Signed and Sealed this
Twenty-fourth Day of May, 2016

Michelle K. Lee

Michelle K. Lee
*Director of the United States Patent and Trademark Office*